United States Patent [19]

Kinnan

[11] Patent Number: 4,618,287

[45] Date of Patent: Oct. 21, 1986

[54] TECHNIQUES FOR ESTABLISHING INGROUND SUPPORT FOOTINGS AND FOR STRENGTHENING AND STABILIZING THE SOIL AT INGROUND LOCATIONS

[75] Inventor: Frank Kinnan, Camas Valley, Oreg.

[73] Assignee: Electric Power Research Institute, Palo Alto, Calif.

[21] Appl. No.: 637,127

[22] Filed: Aug. 2, 1984

Related U.S. Application Data

[62] Division of Ser. No. 458,817, Jan. 18, 1983.

[51] Int. Cl.[4] ..... E02D 5/64

[52] U.S. Cl. ..... 405/232; 37/2 R; 52/296; 52/514; 405/216; 405/231

[58] Field of Search ..... 405/243, 244, 252, 237, 405/251, 253, 232, 231, 229, 216, 222, 223, 262, 263, 269, 258, 233; 52/98, 514, 515, 296, 126.6, 126.7, 127.1, 127.2; 37/2 R; 175/244, 245, 247, 394, 58, 171; 254/201-205, 199, 207, 213, 214

[56] References Cited

U.S. PATENT DOCUMENTS

| | | | |
|---|---|---|---|
| 108,814 | 11/1870 | Moseley | 405/222 |
| 715,362 | 12/1902 | Etheridge | 52/297 X |
| 1,157,444 | 10/1915 | Stewart | 405/232 |
| 2,133,563 | 10/1938 | Parks et al. | 405/251 X |
| 2,203,881 | 6/1940 | Schwab et al. | 405/263 |
| 2,237,383 | 4/1941 | Agostineto | 175/394 X |
| 2,775,428 | 12/1956 | Monthan | 37/2 R |
| 2,897,553 | 8/1959 | Gorrow | 405/216 |
| 3,307,643 | 3/1967 | Ferri | 37/2 R X |
| 3,385,070 | 5/1968 | Jackson | 405/243 |
| 3,717,944 | 2/1973 | Clegg | 37/2 R |
| 4,398,360 | 8/1983 | Kessler | 37/2 R |

FOREIGN PATENT DOCUMENTS

| | | | |
|---|---|---|---|
| 86047 | 8/1957 | Netherlands | 405/253 |
| 233372 | 4/1925 | United Kingdom | 405/243 |

*Primary Examiner*—Dennis L. Taylor

*Attorney, Agent, or Firm*—Flehr, Hohbach, Test, Albritton & Herbert

[57] ABSTRACT

A system for and a method of establishing an inground footing for supporting a post, pole or other such object, especially a replacement utility pole is disclosed herein. An open-ended, hollow casing of particular longitudinal configuration is utilized as the main component for the footing, and to this end, is threaded into the ground. A specific apparatus for threading the casing into the ground is also disclosed herein along with its method of operation. In addition, a method of adding strength and stabilization to the soil at a particular ground location, for example, a location surrounding the casing just mentioned is disclosed herein. This latter method is carried out utilizing a specific apparatus for injecting grout into the inground location to be strengthened and stabilized.

8 Claims, 15 Drawing Figures

TECHNIQUES FOR ESTABLISHING INGROUND SUPPORT FOOTINGS AND FOR STRENGTHENING AND STABILIZING THE SOIL AT INGROUND LOCATIONS

This is a division, of application Ser. No. 458,817 filed on Jan. 18, 1983.

The present invention relates generally to techniques for establishing inground support footings and more particularly to a specific technique for establishing an inground footing for supporting a pole, post or other like object, especially a replacement utility pole, utilizing a specifically configured hollow casing which is threaded into the ground. By replacement pole, it is meant herein either a different new pole or the original pole reinforced in accordance with the present invention, e.g. by means of "stubbing". The present invention also relates particularly to a specific apparatus for and method of threading the casing just mentioned into the ground and a specific method of adding strength and stabilization to the soil at a particular inground location, for example, in the soil surrounding the casing just mentioned by injecting grout into the soil by means of a specifically designed apparatus.

In the utility field, it is quite common to replace damaged utility poles with replacement poles. This is presently being done manually and requires the removal of the damaged or fallen pole and its inground stump since the new pole must be placed in the precise location of the old pole. This is because the new pole serves to support the same telephone or power lines as did the old pole.

The presently used manual technique for replacing utility poles is time-consuming and quite expensive. This is especially true when one considers that as many as 100,000 poles are replaced annually at an average cost of approximately $800.00 per pole including labor and pole cost (at today's prices).

In view of the foreoing, it is an object of the present invention to provide a technique for replacing damaged utility poles (with a new or replacement pole) in a rapid, economical and yet reliable manner.

Another object of the present invention is to install or reinforce or upgrade a replacement utility pole primarily by automated means and without having to remove the inground stump of the previous pole or replace the complete pole.

Still another object of the present invention is to provide a rapid, economical and yet reliable technique for establishing an inground footing which may be configured not only to support a utility pole (either a new one or a replacement pole), but also for supporting other types of poles, posts or similar structures as well as other members requiring support such as towers.

A further object of the present invention is to provide an elongated, hollow casing which serves as the primary component in establishing the support footing referred to immediately above.

Still a further object of the present invention is to provide a hollow casing of the last-mentioned type which is specifically configured to be threaded into the ground in a rapid and reliable manner and without plugging internally.

Yet a further object of the present invention is to provide the forwardmost end of the last-mentioned casing with a configuration which further facilitates threading the casing into the ground.

Another object of the present invention is to provide a specific technique for threading the last-mentioned casing (and other such members) into the ground and particularly a technique which aids in threading the casing (or other member) through especially difficult soil including rockladen soil.

Still another object of the present invention is to provide a technique for adding strength to the last-mentioned casing once the latter has been threaded into the ground by mixing the soil surrounding the casing with a particular grout composition (prior to or after threading it into the ground) and/or by filling the top end section of the casing with the same composition.

A further object of the present invention is to provide a specific technique for injecting the last-mentioned grout composition into the soil surrounding the casing, specifically in a way which is carried out prior to or after placement of the casing in the ground so as to facilitate threading the latter in place while, at the same time, causing the grout composition to mix with the surrounding soil.

Still a further object of the present invention is provide a technique apart from the previously mentioned support footing (and casing) for adding strength and stabilization to soil at a particular inground location by injecting grout therein and a particular apparatus for accomplishing this.

Other objects and features of the present invention will become apparent herein from the detailed description to follow. For the moment, it suffices to briefly describe the various aspects of the present invention.

One such aspect resides in a technique for establishing an inground footing for supporting a pole, post or other such member such as a tower, especially a replacement utility pole, as indicated previously. This technique utilizes a generally cylindrical hollow casing having open top and bottom ends as well as (1) an uppermost end section including the top end, (2) a smaller diameter lowermost end section including the bottom end, and (3) a radially tapering intermediate section joining the two. The casing also has a helically threaded outer surface between its ends sufficient to allow the casing to be threaded into the ground starting at its bottom end. A powered apparatus is fixedly connected to the top end of the casing for rotating the latter about its own axis while, at the same time, urging the entire casing forward (in the direction of its bottom end) whereby to thread the casing into the ground so that the latter may serve as the previously recited support footing. The helical threads in the outer surface of the casing and the way in which the outer surface tapers from its larger uppermost end section to its smaller bottommost end section combine to make it possible to thread the casing in the ground and to do it in a rapid and reliable manner.

While the inground casing just described may serve to support many different types of posts, poles and other such members, it is especially suitable for supporting a utility pole and particularly a replacement pole. In this latter case, the casing is threaded into the ground concentrically around the stump of the previous pole and therefore the stump does not have to be removed.

Another apsect of the present invention resides in the particular way in which the casing just described is threaded into the ground. The apparatus disclosed herein to accomplish this is one which not only rotates the casing about its own axis while the casing is urged forward, but also causes the casing to vibrate about its axis of rotation, whereby to aid in the threading process.

This vibrational approach may also be used for threading other members into the ground.

Still another aspect of the present invention resides in a particular method of adding strength and stabilization to the soil at a particular inground location. This method requires a specific grout composition, for example, a cement or epoxy resin slurry, which when placed in the soil adds strength and stabilization thereto. In accordance with the present method, this composition is injected into the ground using a particular apparatus to do so with sufficient strength to cause the soil surrounding the batch to fracture as the batch passes therethrough. In this way, the ultimate resting position of the grout composition can be controlled. This particular technique can be used to strengthen and stabilize hillsides, mining tailings and the like. It can also be used to strengthen the inground casing recited above.

The various aspects of the present invention just recited above will be discussed in more detail hereinafter in conjunction with the drawings wherein.

Figure 2:
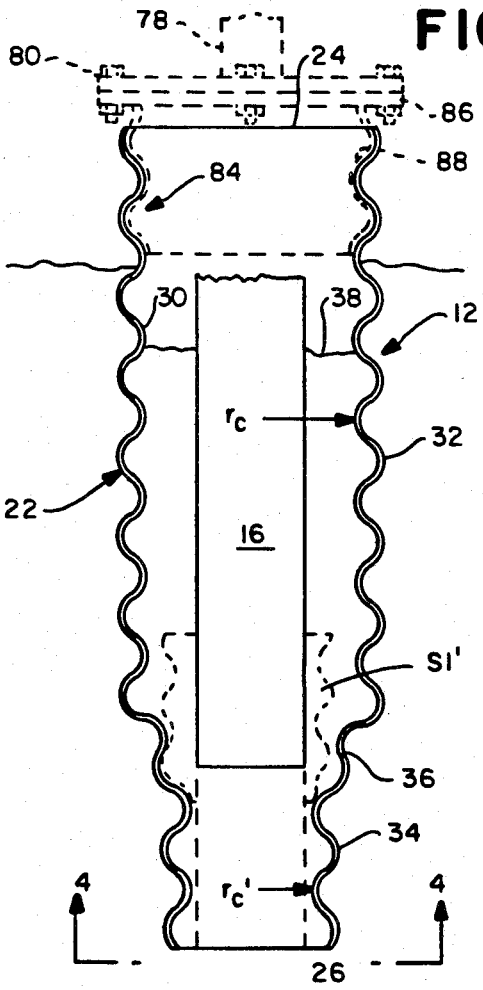
FIG. 2 is an enlarged, longitudinal sectional view of an inground casing which forms part of the system illustrated in FIG. 1 and which is designed in accordance with the present invention.
Figure 7:
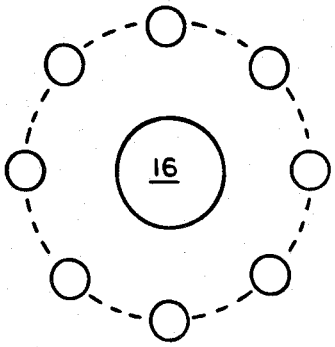
Figure 8:
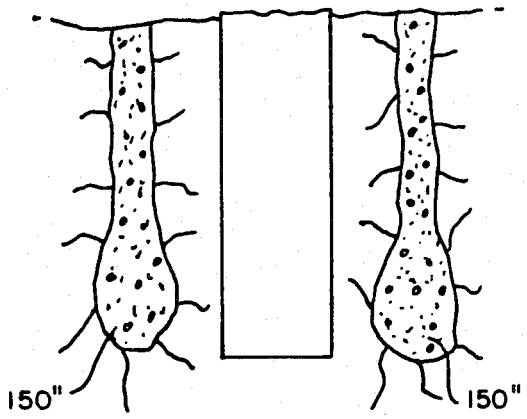
Figure 9:
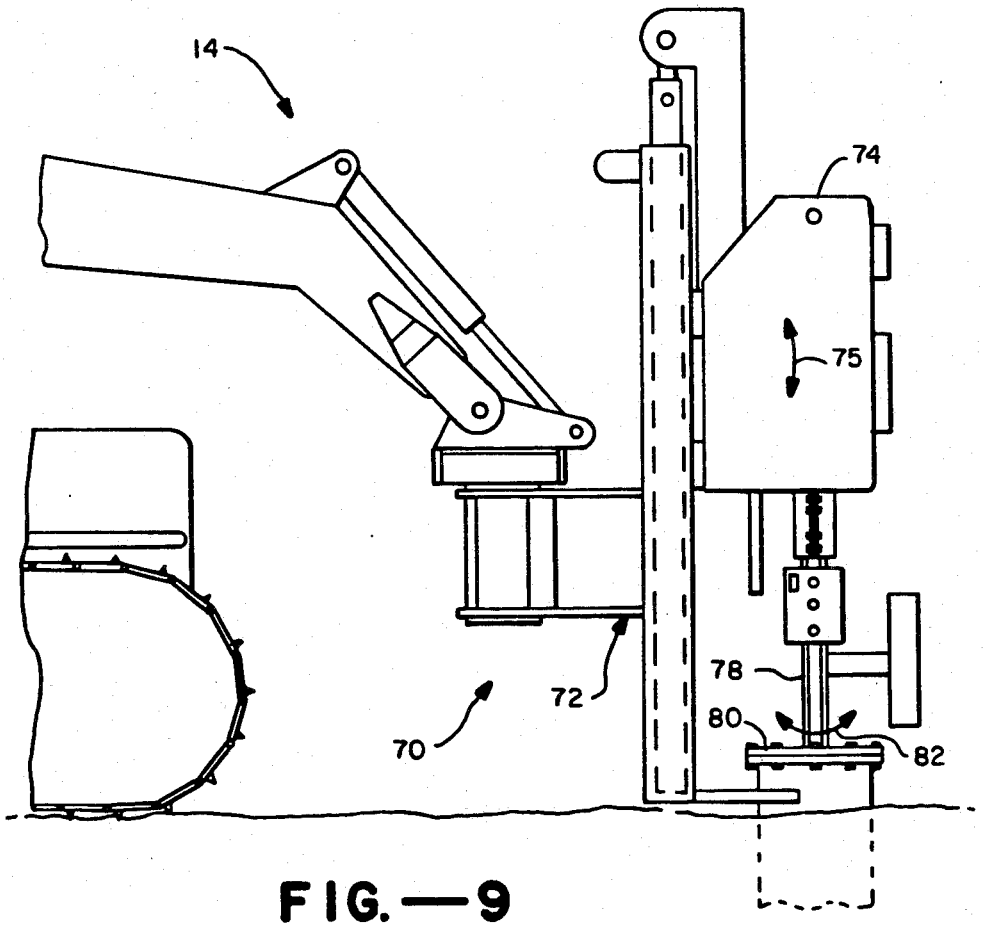
Figure 10:
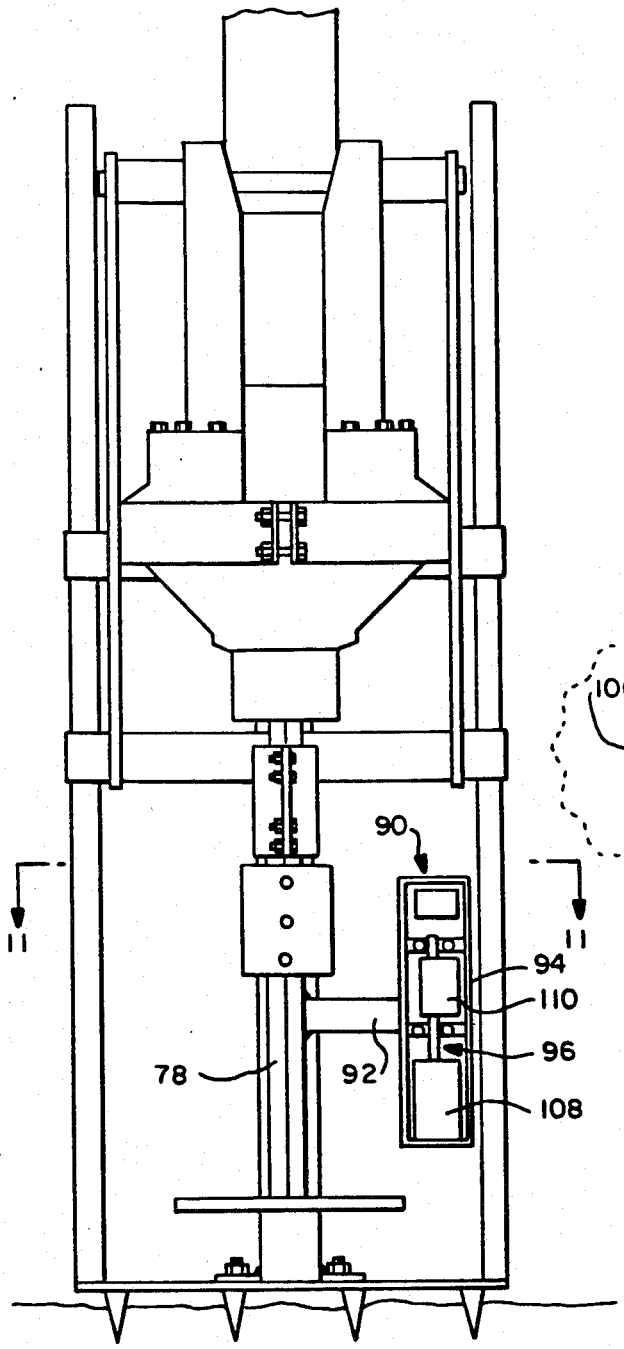
Figure 11:
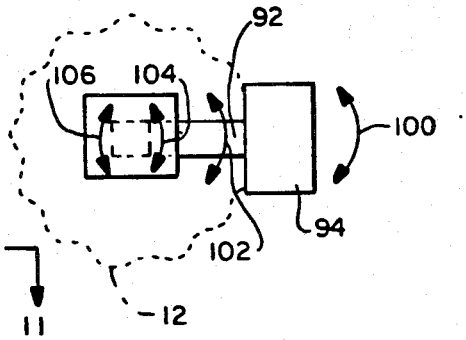
Figure 12:
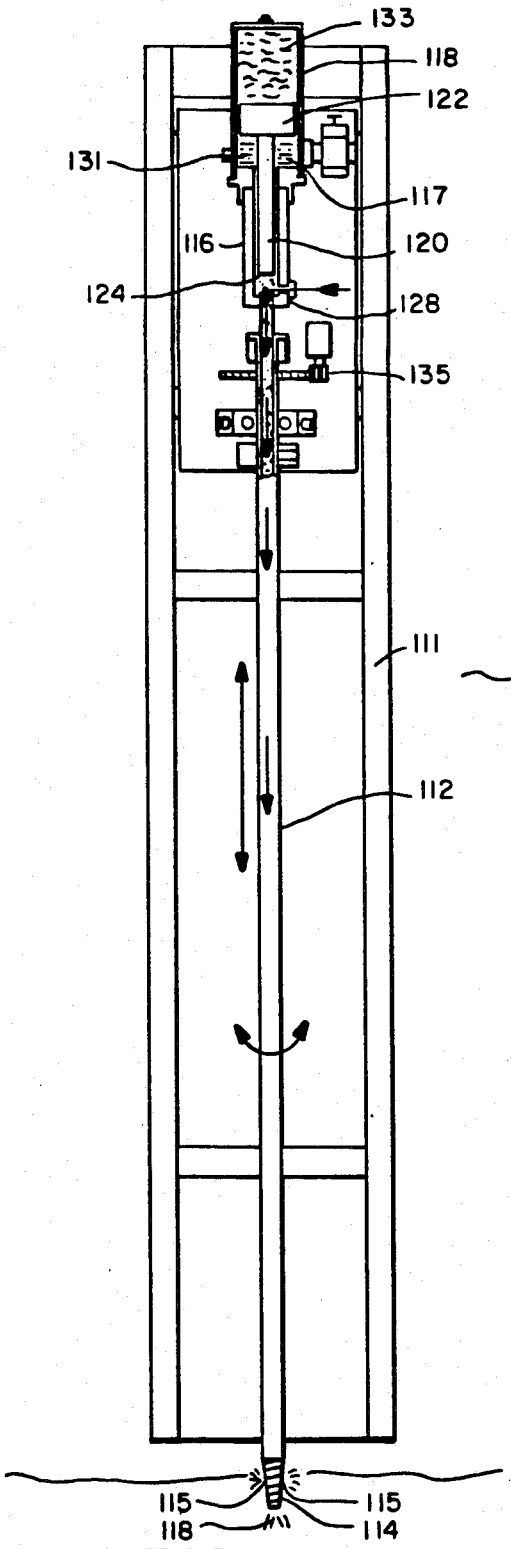
Figure 13:
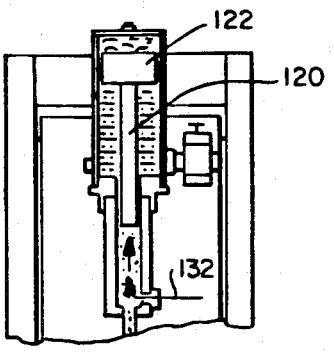
Figure 14:
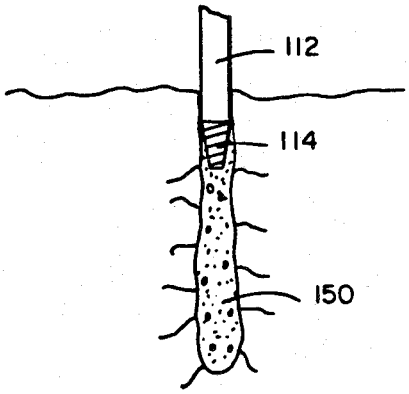
Figure 15:
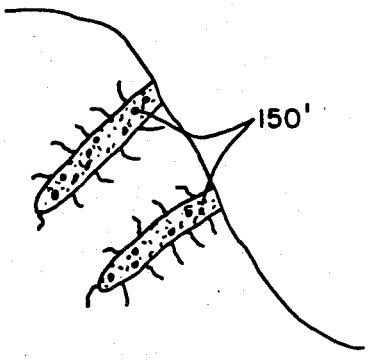

FIGS. 7 and 8 diagrammatically illustrate in plan and vertical sectional views, respectfully, a preferred step which is carried out in threading the casing illustrated in FIG. 2 into the ground;

FIG. 9 is a side elevational view of an apparatus designed in accordance with the present invention for threading the casing illustrated in FIG. 2 into the ground;

FIG. 10 is a front view of a portion of the apparatus illustated in FIG. 9;

FIG. 11 is a cross-sectional view of the apparatus of FIGS. 9 and 10, taken generally along line 11—11 in FIG. 10;

FIGS. 12 and 13 are partially broken away side elevational views of an apparatus (illustrated in different operating positions) designed in accordance with the present invention for injecting a grout composition into the ground; and FIGS. 14 and 15 diagrammatically illustrate a method of adding strength and stabilization to the soil at a particular inground location.

Figure 1:
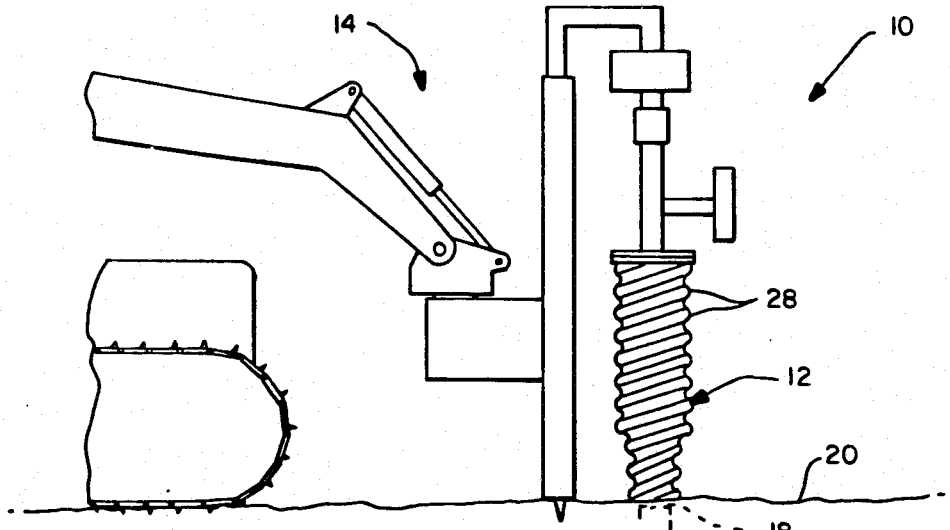
FIG. 1 is a side elevational view of a system for establishing an inground support footing in accordance with the present invention.

Turning now to the drawings, wherein like components are designated by like reference numerals throughout the various figures, attention is first directed to FIG. 1. This figure illustrates a system generally indicated by the reference numeral 10 for establishing an inground structural arrangement which serves as a support footing for a replacement utility pole. This system includes a specifically designed rigid hollow casing 12, for example, one constructed of steel having opened top and bottom ends and a helically threaded outer surface between its ends sufficient to allow its casing to be threaded into the ground starting at its bottom end. The system also includes an apparatus generally indicated at 14 which is shown disengagably connected to the top end of the casing for rotating the latter about its longitudinal axis while, at the same time, urging the entire casing forward in the direction of its bottom end, whereby to thread the casing into the ground (see FIG. 2) from the position illustrated in FIG. 1. Because the structural arrangement is intended as a support footing for a replacement utility pole, as indicated above, casing 12 is threaded into the ground around the inground stump which forms part of the removed pole. As illustrated in FIG. 1, the stump, generally indicated at 16, extends vertically with its uppermost end 18 located approximately at ground level indicated by the reference numeral 20.

It should be apparent that for casing 12 to support a utility pole it must be relatively large diametrically, as well as long longitudinally, and its body must be relatively thick. For example, an actual working embodiment of the casing 12 is constructed of steel $\frac{1}{8}$ inch thick, 6 feet long, and 15 inches in diameter. It should be apparent that such a large member is not necessarily easy to thread into the ground. However, as will be seen below, casing 12 is specifically designed not only to make this task possible, but also to make it relatively easy, especially combined with certain features of apparatus 14 to be described hereinafter.

Referring to FIG. 2, casing 12 is shown including an integrally formed main body 22 which is constructed of steel or other suitable rigid material and which includes an opened top end 24 and an opened bottom end 26. As indicated above, the casing (actually the casing body) has a helically threaded outer surface between its top and bottom ends sufficient to allow the casing (casing body) to be threaded into the ground starting at its bottom end. These helical threads are generally indicated at 28 in FIG. 1 and need only be present on the external surface of the casing body in order to facilitate threading of the latter into the ground. However, as illustrated in FIG. 2, the entire casing body is corrugated from its top end to its bottom end in a way which not only provides outer helical threads 28 but also corresponding inner threads 30 (FIG. 2) which further facilitate the threading process and combine with the outer threads to add longitudinal rigidity to the casing when the latter is utlimately threaded into the ground. In addition, the corrugated, helical configuration of the casing in combination with its tapered configuration allows one casing (or more) to be threaded axially into another in order to form a longer single casing.

Still referring to FIG. 2, overall casing body 22 is shown including an uppermost end section 32 including top end 24, a lowermost end section 34, which includes bottom end 26 and which is substantially smaller in diameter than the uppermost end section, and a radially tapering intermediate section 36 joining together sections 32 and 34. As will be explained in more detail below, this particular configuration serves three important functions. First, it facilitates the threading process and, in some cases, makes the threading process possible when it might not have otherwise been. Second, because of this particular configuration, after the casing is ultimately threaded into position in the ground, as shown in FIG. 2, the soil level within the casing which is generally indicated at 38 is below ground level 20 by a fixed amount. This has certain advantages to be discussed hereinafter. Third, again because of the configuration of the casing, the soil outside but directly adjacent the uppermost end section 32 of the casing body is relatively compact compared to the normal ground conditions in the vicinity of the casing.

Figure 3:
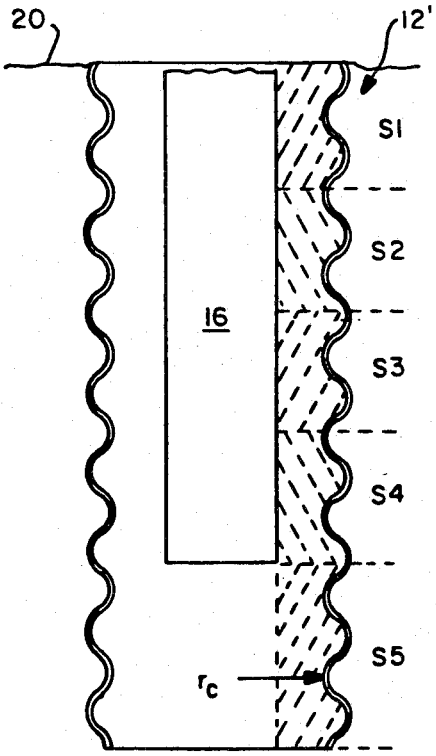
FIG. 3 is a view similar to FIG. 2 of a different type of casing than the one illustrated in FIG. 2 and specifically one which is not as satisfactory.

In order to more fully appreciate why the configuration of body 22 is able to facilitate the threading process, it must be compared with a casing 12' which is illustrated in FIG. 3. This latter casing is identical in every way to casing 12 except that casing 12' has the same diameter (or radius) throughout its entire length as the uppermost section 32 of casing 12 (e.g., $r_c$). This also means that the volume per axial foot within the casing is constant. As a result, as increments or plugs of soil generally indicated at $S_1$–$S_5$ enter the casing body from its bottom open end (as the casing is drilled into place), they are forced upward around stump 16 within equivalent volumetric spaces in a relatively compressed manner. This tends to cause the compressed plugs to break free from the rest of the soil and, in effect, bind with the casing body as it is rotated. This, in turn, makes it more difficult, if not impossible, for the casing to be drilled further into the ground. In contrast thereto, it should be noted that any given soil segment or plug entering casing body 22 as the latter is drilled into the ground has an outermost radius $r_c'$ dictated by the smaller diameter defining lowermost casing section 34. As a result, this soil segment which is generally indicated at $S_1'$ in FIG. 2 moves into a substantially larger volume as it moves upward into its uppermost section 32 of the casing body. As a result, this soil segment is not compressed but rather has room to break apart without tending to bind with the casing in the manner just described.

Referring again to FIG. 3, it should be apparent that as the casing body 12' is threaded into its ultimate inground location, the entire interior space between stump 16 and the inner surface of the casing body will be filled with soil. In other words, the initial soil increment $S_1$ is ultimately forced upward to the very top of the casing body where it lines up with ground level 20. On the other hand, as the soil increment $S_1'$ and subsequent increments enter casing body 22 from bottom end 26, they move up into a larger volume defined by the uppermost casing section 32. As a result, the amount of soil actually entering the casing (volumewise) is less than the volume in the entire casing (because of the larger uppermost section compared to the lowermost section). As a result, when the casing reaches its ultimate inground position, only a portion of its body fills with soil, thereby resulting in a lower soil level 38. At the same time, the soil immediately outside the lowermost section 34 of the casing is forced radially outward by intermediate tapering section 36 as the casing body moves downward. As a result, the soil just outside and surrounding uppermost section 32 when the casing is in its ultimate position is relatively compact compared to the normal ground conditions in the vicinity of the casing. This more compact soil aids in strengthening the casing and in maintaining it in the ground.

Figure 4:
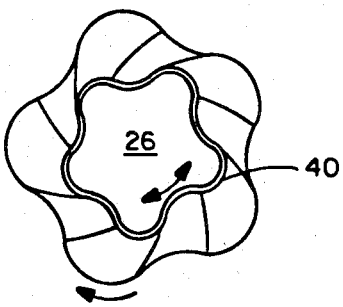
FIG. 4 is the bottom plan view of the casing illustrated in FIG. 2, taken generally along line 4—4 in FIG. 2.

Overall casing 12 has been described as having advantages as a result of its longitudinal configuration, as discussed immediately above. A further advantage resulting from the casing's configuration is illustrated in FIG. 4. This figure shows the bottom end of the casing and specifically opening 22 in plan view. As seen there, opening 26 is defined by a series of connected radially inward and radially outward curving segments 40 which have been found to more readily cut through the soil than a true circular configuration or even a circular configuration with serrations or teeth. The radially inward and radially outward curving segments are achieved by providing opening 26 entirely within a plane perpendicular to the axis of the casings. In this way, the outer helical threads 28 and inner threads 30 are cut in the same plane. Each radially outward curve corresponds to the radially outward turn of the corrugation in the casing body and each radially inward curve corresponds to an inner turn in the corrugation. In other words, by cutting the corrugation in the direction perpendicular to the axis of the casing, the desired radially inward and radially outward curving configuration is automatically provided.

Figure 5:
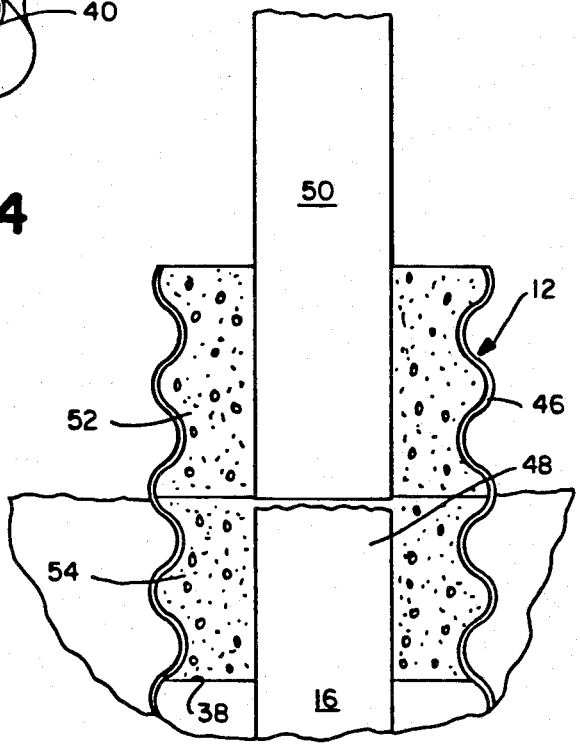
FIG. 5 illustrates in partially broken away plan view an inground structural arrangement which is designed in accordance with one embodiment of the present invention and which serves as a support footing for a replacement utility pole.

Having described overall casing 12, reference is made to FIG. 5 which illustrates an inground structural arrangement including this casing which serves as a support footing for a specific replacement utility pole. The overall structural arrangement is generally indicated at 42 and the replacement pole is shown at 44. It is to be understood that this replacement pole can be either the original pole (without its stump 16) or a totally different pole. It is preferable to use the original for economical reasons. However, this presupposes that the original in combination with the present structural arrangement is structurally satisfactory. For purposes herein, the term "replacement pole" means either the original pole (without its stump) or a different pole. The casing 12 is shown threaded into the ground such that a top end segment 46 is located above ground level 20. At the same time, the soil level 38 within casing 12 is below ground level, thereby exposing an uppermost end segment 48 of stump 16.

As illustrated in FIG. 5, a bottom end section 50 of replacement pole 44 is disposed within top end segment 46 of casing 12 in axial alignment with stump 16. The new pole is held in this position by filling the space between it and the casing with a suitable grout composition, for example, cement or epoxy resin initially provided in slurry form. This grout composition which is indicated at 52 not only fixedly connects bottom end section 50 of pole 44 with the casing, but also adds strength to the casing. Further strength is added to the casing by filling the area surrounding the exposed section 48 of stump 16 with grout as indicated at 54.

Figure 6:
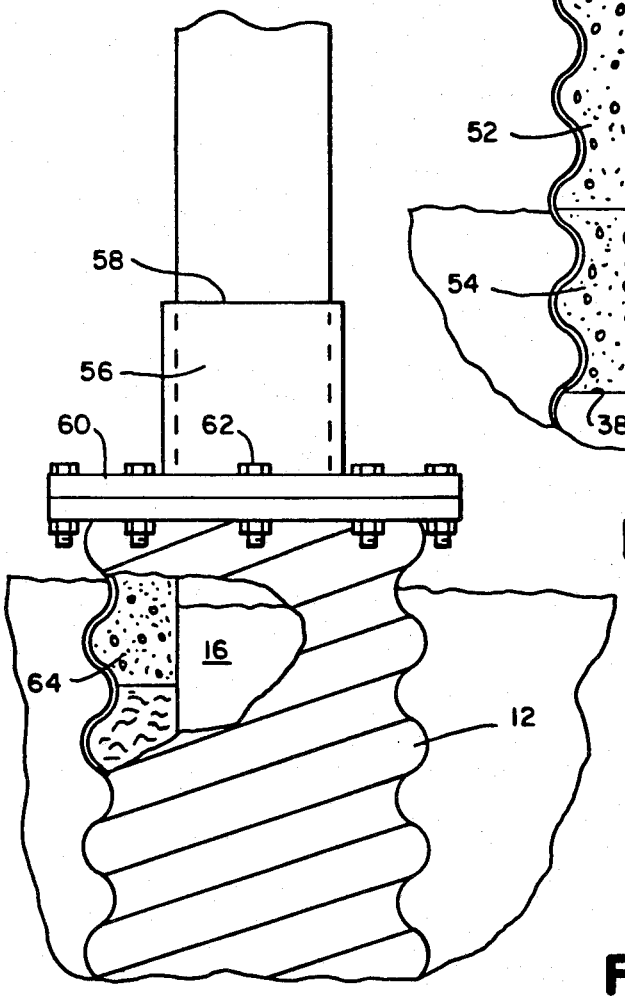
FIG. 6 is a view similar to FIG. 5 but illustrating an inground structural arrangement serving as a support footing for a utility pole in accordance with a second embodiment of the present invention.

A modified inground structural arrangement 42' is illustrated in FIG. 6. This arrangement includes an identical casing 12 threaded into the ground. However, in arrangement 42' the top end 24 of the casing may be located at or only slightly above ground level, as shown. However, casing 12 includes a circumferential connecting flange 54 fixedly connected to its top end. The overall structural arrangement also includes a sleeve 56 having an open top end 58 and a bottom end which may be opened but is preferably closed and which includes a second circumferential flange 60 fixedly connected thereto. As seen in FIG. 6, flange 60 is positioned over but fixedly connected to flange 54 by a series of bolts 62, such that sleeve 56 is in axial alignment with the casing. The sleeve is configured to receive bottom end section 50 of replacement pole 44 through its top end 58, as illustrated. If there is room, a grout composition of the type recited above or any other suitable adhesive means may be provided around the entering segment of the pole, between the latter and the sleeve for holding the pole more tightly in place. Also, the space within the casing between the latter and the exposed section 48 of stump 16 may be filled with grout in order to aid in the strengthening of the casing. This grout composition is indicated at 64.

In certain instances, it may be desirable and even necessary to provide structural arrangements 42' rather than arrangement 42. For example, where "breakaway" utility poles are required by local ordinances, arrangement 42' could be utilized with breakaway bolts 62. In this case, the bottom of sleeve 56 would be closed so that the bottom of the utility pole remains within the sleeve. Therefore, should a vehicle inadvertently hit the pole, it would most likely do so with sufficient force to break the bolts and cause the pole and sleeve (including flange 60) to separate from flange 54 and thereby fall to the ground.

From the foregoing, it should be quite apparent that either structural arrangement 42 or 42' can be readily provided by first drilling casing 12 into the ground concentrically around stump 16 starting at the bottom end of the facing. In order to do this, the casing must be rotated about it own axis and urged downward toward its bottom end from its top end, as indicated above. Overall apparatus 14 referred to initially with regard to FIG. 1, includes an arrangement 70 to accomplish this. Arrangement 70 includes a structural assembly 72 which supports a torque head 74 for vertical movement in the upward and downward direction, as indicated by two-way arrow 75. The support assembly also includes a piston and cylinder type of arrangement 78 for moving the torque head upward and downward. At the same time, the torque head supports a vertically downward extending shaft or torque bar 78 and a flange 80 fixedly connected to its lowermost end. The torque head includes a means (not shown) for rotating the shaft about its axis, as indicated by arrow 82.

Flange 80 serves to fixedly disengagably connect the lowermost end of shaft 78 to top end 24 of casing 12. If the casing has its own flange 54 as in structural arrangement 42' (see FIG. 6), this latter flange may be used to connect flange 80 to the casing, as illustrated in FIG. 9. On the other hand, if casing 12 does not include its own flange as in the overall structural arrangement 42 illustrated in FIG. 5, a separate connecting flange arrangement can be provided. This arrangement is illustrated by dotted lines in FIG. 2 at 84. As seen there, arrangement 84 includes an uppermost flange 86 fixedly joined to the top end of a threaded segment 88. Segment 88 is configured to thread into the top end of the casing sufficient to fixedly maintain flange 86 in place over the top end of the casing. Because arrangement 84 threads into casing 22 in the same direction (for example clockwise) as the casing is threaded into the ground, segment 88 will remain in place as the casing is threaded into the ground.

Once flange 80 fixedly connected to shaft 78 is connected with either flange 54 or flange 86 and the entire casing is positioned over stump 16 in the manner illustrated in FIG. 1, the shaft is rotated (for example, clockwise), and the entire torque head is urged downward by means of piston and cylinder assembly 76 in order to urge the casing downward. This, in turn, causes the casing to be threaded into the ground and over stump 16. In a preferred embodiment, apparatus 14 includes means for producing high pressure water jets into the soil near the bottom end of the casing in order to cut a Kerf therein before the casing is threaded into place. This preripping procedure also provides lubrication for the threading operation. In this same embodinent, the casing is rotated at approximately fifteen revolutions per minute, although the apparatus is not limited to this particular rotational speed.

Overall apparatus 70 as described thus far may be readily provided and does not per se form part of the present invention other than as part of overall system 10. However, in accordance with the present invention, overall apparatus 14 includes an arrangement generally indicated at 90 in FIG. 10 which cooperates with shaft 78 for causing casing 22 to vibrate about its axis of rotation as the casing rotates, whereby to aid in threading the casing into the ground. More specifically, this arrangement allows the casing to move through relatively sticky and highly compacted soil and soil containing rock whereby it might be able to without such rotation.

As best illustrated in FIG. 10, vibration arrangement 90 includes a relatively rigid torque arm 92 which is welded or otherwise fixedly connected at one end to shaft 78 and which extends outwardly therefrom in a direction normal to the axis of the shaft. A housing 94 is fixedly connected to the otherwise free end of torque arm 92 and contains a readily providable mechanism 96 and a counterweight 98 cooperating with one another for vibrating the housing in a way which vibrates the torque arm only in a plane through the connecting arm and normal to shaft 78, that is, about the axis of the shaft. This, in turn, causes the shaft to vibrate about its axis only, thereby causing the casing to vibrate about its axis only. This is best illustrated diagrammatically in FIG. 11 where the housing 94 is shown vibrating in the direction of two-way arrow 100. This imparts vibration to the torque arm about the axis of shaft 78, as indicated by arrow 102, which, in turn, causes the shaft itself to rotate about its axis, as indicated by two-way arrow 104. The shaft is also shown in FIG. 11 rotating clockwise, as indicated by arrow 106, at the same time.

The overall apparatus 14 can be powered by any suitable means, typically hydraulically. This is also true for vibrating mechanism 96. In a preferred embodiment, this mechanism is driven hydraulically and includes a drive motor 108 having its output shaft connected to an eccentric cam 110, both of which are contained within housing 94 along with suitable bearings and seals. The counterweight 98 is also positioned within the housing in a location which prevents the vibrating mechanism from causing the connecting arm to twist about its own axis. In a preferred embodiment, the frequency of vibration produced by mechanism 96 is tuned to the resonance of the torque arm-shaft combination so that large impulse torques are transmitted into the casing. Torques as high as 45,000 ft.-lbs. can be applied to the casing in addition to the constant torque being applied by the torque head which can be, for example, 15,000 ft.-lbs. of constant torque.

Referring to FIGS. 12 and 13, attention is now directed to another type of apparatus which could be used with overall system 10, as will be seen hereinater. This second apparatus which is seen generally indicated by the reference numeral 110 is provided for injecting a grout slurry into the ground. The particular grout contemplated is one which, when placed in the soil, adds strength and stabilization thereto. One example is cement and another is epoxy resin. The grout is mixed with a carrier, preferably water, in the form of an overall slurry and this slurry is injected into the ground in a controlled manner using apparatus 110.

As seen in FIG. 12, apparatus 110 includes an overall support housing 111 containing an elongated hollow barrel 112 carrying a nozzle 114 at its lowermost end. This nozzle may be of any conventional type having an end opening 118 for the passage of grout slurry within the barrel, and it may also include side openings 115 for directing grout slurry out of the barrel at acute angles with its axis. An upper end section 116 of the barrel opens into a larger chamber 117 defined by an uppermost barrel housing 118. An elongated piston 120 having an enlarged back end 122 which serves as a plunger is coaxially positioned partially within the barrel section 116 and partially within chamber 117. The piston is supported in this position for axial movement by its plunger 122.

In the actual operation of overall apparatus 110, the grout slurry is introduced into the barrel under the front end 124 of piston 120 through an appropriate inlet valve 128, as indicated by arrows 130. The barrel is filled up to the level of the inlet valve which lies immediately below the piston when the latter is in its extended, "spent" position, illustrated in FIG. 12. Overall apparatus 110 includes suitable means including a hydraulic dump valve 129 and hydraulic oil 131 within housing 118 below plunger 122 for retracting the piston further into chamber 117, specifically into a loaded position. As this is done, a vacuum is created under the piston thereby causing more grout slurry to enter the barrel in order to entirely fill the latter as indicated by arrows 132. At the same time, nitrogen gas or other compressible gas 133 which is provided in chamber 117 above plunger 122 is compressed by the plunger, thereby resulting in a larger pressure behind the plunger.

Once the piston is in its loaded position, dump valve 129 is actuated to release the oil pressure in front of the plunger, thereby causing the entire piston to move from its retracted position to its spent position with great force. In fact, this force is intensified by the difference in diameter between the piston's narrower front end and its enlarged plunger. This, in turn, causes the grout slurry to be blown out of the barrel through nozzle 114 with even greater force due to the amplifying effect caused by the piston configuration. It has been found that the grout slurry can be injected from the barrel with sufficient force to penetrate even compact soil sufficient to cause the surrounding soil to fracture. This in turn means that the ultimate location of the grout in the soil can be controlled by the proper selection of different aspects of the overall apparatus and the grout composition itself. For example, the particular way in which the composition is ejected from barrel 112 and the amount of force it has will depend on the particular nozzle selected, the size of the barrel and the length of piston 120 as well as the amount of force applied to the piston itself. Also, the slurry composition will in part dictate how it is ejected from the nozzle and the amount of force it has. In an actual working embodiment, the grout slurry contains up to 80% solids (grout) by weight, the rest being water. Particular grout used was epoxy.

In a preferred embodiment of apparatus 110, nozzle 114 is moved vertically downward into the ground to the desired location (for injecting grout). At the same time, it may be desirable to rotate the nozzle about its own axis. Suitable means may be provided for the purpose. Such means may include a drive piston (not shown) for axial movement and a combination motor/-gear gear 135 for axial rotation.

FIG. 14 illustrates how the grout which is generally indicated at 150 is in3ected into the ground using apparatus 110. In this particular illustration, the nozzle 114 includes only one opening at its tip and the grout slurry exits barrel 112 through that opening only. Note that the soil in front of the nozzle has been fractured by the grout and filled with the latter. Obviously, this fractured pocket will vary with the amount of grout being ejected, its force, and its composition. However, once the grout has been so injected into the soil and allowed to solidify, which will eventually occur when its aqueous component evaporates, the solidified grout aids in strengthening and stabilizing the soil. As a result, individual pockets 150' of grout can be injected into hillsides for stabilizing the latter, as best illustrated in FIG. 15. These same pockets can be injected in the necessary area around mining tailings for the same purpose.

As indicated previously, overall apparatus 110 can also be used with overall system 10 illustrated in FIG. 1. More specifically, pockets of grout can be injected into the soil surrounding previously described stump 16 before casing 22 is threaded into the ground at the anticipated location of the casing. This is best illustrated in FIGS. 7 and 8. The pockets are generally indicated at 150". The dotted circle shown in FIG. 7 corresponds to the anticipated location of casing 22 and therefore has the same diameter as the casing and is concentric with the stump. In this way, while the grout slurry is primarily aqueous, the casing is threaded into place. The grout slurry serves as a lubricant during this process, thereby aiding in the threading operation. At the same time, the threading operation causes the grout to mix with the soil, both within and immediately outside the casing. As a result, after the casing has been threaded into its ultimate location, and after the grout has hardened, it serves as a means of strengthening the casing by strengthening the soil on either side of it. While it is preferable to inject the grout into the ground before the threading procedure, it could be done afterwards for strengthening the overall arrangement.

The foregoing has been a description of (1) an inground structural arrangement serving as a support footing for a replacement utility pole including a specifically designed casing, (2) a system for and method of providing such an arrangement, (3) a specific apparatus for threading the casing into the ground, (4) a method of adding strength and stabilization to the soil at a particular inground location, and (5) an apparatus utilized with the last-mentioned method for injecting grout into the ground in order to carry out the method. These latter two items, that is, the soil strengthening and stabilizing method and its associated grout injecting apparatus are described apart from and as part of the above-mentioned system (Item 2). However, it is to be equally understood that the casing forming part of the inground structural arrangement (Item 1), could be used as part of a footing for supporting other posts, poles and like objects besides replacement utility poles. In the same manner, the system for providing the arrangement of Item 1 can be used to provide other types of structural arrangements. Morever, the apparatus provided for threading the casing in the ground (Item 3), can be utilized for threading other members into the ground besides hollow casings.

What is claimed:

1. A casing especially suitable for use as a footing around an inground segment of a post, pole or other such object, said casing comprising a main body having opened top and bottom ends larger in diameter than the maximum width of said inground segment, an uppermost cylindrical end section including said top end, a lowermost cylindrical end section including said bottom end, said lowermost end section being smaller in diameter than said uppermost end section, and a radially tapering intermediate section joining said end sections, said main body also having a helically threaded outer surface between its ends sufficient to allow the casing to be threaded into the ground around said inground sections starting at its bottom end, the bottom and intermediate sections of said casing serving to limit the amount of soil entering the casing from its bottom end as the casing is threaded into the ground where by soil initially entering the bottom end of said casing as the latter is threaded into the ground eventually moves through the tapering intermediate section and into the uppermost end section where it has room to break up.

2. A casing according to claim 1 including flange means located at its top end for connecting said top end with a means for rotating the casing so as to thread the latter into the ground.

3. A casing according to claim 2 wherein said flange means is fixedly connected with and forms part of the top end of said casing body.

4. A casing according to claim 2 wherein said flange means is separate from but threadedly connectable with said casing body for connecting the latter with said rotating means whereby the flange means can be readily removed when the casing is threaded into the ground.

5. A casing according to claim 1 wherein the bottom opened end of said main body lies in a plane normal to the body's axis and, because of the helically threaded outer surface of said body, said bottom opened end is defined by a series of connected radially inward and radially outward curving segments which cut through the grounds more readily than a circular configuration as the casing body is threaded into place.

6. A casing according to claim 1 wherein said casing body is corrugated along its length from said top end to said bottom end so as to provide said helically threaded outer surface and a helically threaded inner surface between its ends.

7. A casing especially suitable for use as a support footing around an inground segment of a pole, post or other such object, said casing comprising a generally cylindrical hollow casing body having an opened top end and a smaller in diameter bottom end, both of said ends being larger in diameter than the maximum width of said inground segment, said body also having an uppermost cylindrical end section including said top end and a radially inwardly tapering section extending down from and joining said uppermost sections, said casing body having a helically threaded outer surface extending at least from the top of said radially inwardly tapering section to said bottom end sufficient to allow the casing to be threaded into the ground around said inground segment starting at its bottom end, the bottom and tapering sections of said casing serving to limit the amount of soil entering the casing from its bottom end as the casing is threaded into the ground whereby soil initially entering the bottom end of said casing as the latter is threaded into the ground eventually moves through the tapering section and into the uppermost end section where it has room to break up.

8. A casing according to claim 7 wherein said casing body has a lowermost cylindrical end section including said bottom end extending down from and joining said tapering section and a helically threaded outer surface.

* * * * *